US006493998B1

(12) United States Patent
Pryor

(10) Patent No.: US 6,493,998 B1
(45) Date of Patent: Dec. 17, 2002

(54) FLARE STRUT SYSTEM

(76) Inventor: John D. Pryor, 4028 39th Ave., Oakland, CA (US) 94619

( * ) Notice: Subject to any disclaimer, the term of this patent is extended or adjusted under 35 U.S.C. 154(b) by 0 days.

(21) Appl. No.: 09/354,524

(22) Filed: Jul. 15, 1999

(51) Int. Cl.[7] ..... E04B 7/04; E04G 25/02

(52) U.S. Cl. ..... 52/92.2; 52/167.3; 52/739.1; 52/127.2

(58) Field of Search ..... 52/790.1, 167.3, 52/719, 739.1, 127.2, 92.2, 93.1, 291; 248/354.1, 354.3, 354.5, 534, 536, 538

(56) References Cited

U.S. PATENT DOCUMENTS 1,076,290 A * 10/1913 King ..... 52/93.1 X
1,762,740 A * 6/1930 Rains ..... 52/151
3,296,752 A * 1/1967 Philp ..... 52/93.1 X
3,700,202 A * 10/1972 Donnels ..... 248/354.4
3,817,006 A * 6/1974 Williams ..... 52/127.2
4,173,857 A * 11/1979 Kosaka ..... 52/642
4,304,078 A * 12/1981 Meriwether, Jr. ..... 52/127.2
4,596,371 A * 6/1986 Clark ..... 248/354.3
5,253,839 A * 10/1993 McClure ..... 248/354.1
5,868,222 A * 2/1999 Charbonneau ..... 248/354.5 X
6,058,663 A * 5/2000 MacKarvich ..... 52/167.3
6,155,019 A * 12/2000 Ashton et al. ..... 52/739.1

* cited by examiner

*Primary Examiner*—Carl D. Friedman
*Assistant Examiner*—Brian E. Glessner
(74) *Attorney, Agent, or Firm*—Oppenheimer Wolff & Donnelly LLP; Claude A. S. Hamrick

(57) ABSTRACT

A Flare Strut System including a plurality of strut pairs, each forming an assembly for transferring force between wall and a roof continuity element. Each assembly is comprised of two elongated strut elements, or load transfer members, each including a longitudinal rotation and adjustment member at one end thereof, a first end connector assembly for facilitating connection of one end of the strut element to a wall, and a second end connector assembly for facilitating attachment of the other end of the strut element to a continuity element connection assembly, the latter assembly being adapted to combine with a corresponding connection assembly and sandwich the continuity element therebetween. Each strut element is adapted to angularly intersect both the engaged wall and the continuity element at acute angles which are determined by the particular buildings design.

27 Claims, 6 Drawing Sheets

FLARE STRUT SYSTEM

BACKGROUND OF THE INVENTION

1. Field of the Invention

The present invention relates generally to devices used to interconnect and transfer forces between structural members such as the walls of a building and its roof framing system, and more particularly, to a strut system for providing direct, simplified and cost effective seismic connections that can articulate in three planes while transferring both tension and compression forces from the walls of new and existing concrete, concrete "tilt-up" and concrete block buildings to their diaphragm continuity elements.

2. Description of the Prior Art

Tilt-up buildings generally consist of those types of structures that are constructed with precast concrete wall panels that are precast horizontally on the ground, cured, and then tilted up into place. Concrete block walls are similar in character, but are built up block by block. Other concrete walls are typically cast in place.

The timber roof framing systems of older concrete, concrete tilt-up and concrete block buildings (hereinafter referred to generally as "concrete buildings") that were built between the early to mid 1960's were generally constructed with longspan timber roof trusses and timber roof joists. The timber trusses in these buildings were typically oriented to span the short direction of the building. Spacing between these trusses generally varies between 16 and 24 feet. The roof joists generally consist of 2×8's, 2×10's, or 2×12's spaced at 24" o.c., and span between the timber trusses. At the perimeter of the building the roof joists span between the timber trusses and the walls, where they are typically framed onto a timber ledger that is bolted to the wall. Roof sheathing for these buildings typically consists of ⅜" or ½" plywood.

After the mid 1960's, the roof timber framing systems of most concrete as well as other types of buildings were generally constructed with glulam beams, instead of longspan timber trusses, and used a "panelized" roof framing system instead of roof joists. These modifications to the roof framing systems were typically made for economic reasons.

A "panelized" roof framing system consists of timber purlins, timber sub-purlins (also known as stiffeners), and roof sheathing. The roof sheathing typically consists of 4'×8' sheets of ⅜" or ½" plywood, and spans between the sub-purlins. These sub-purlins are generally 2×4's or 2×6's, and span between the purlins. The purlins typically consist of 4×12's or 4×14's and span between the glulam beams (or in some cases longspan timber trusses). The plywood sheathing is typically oriented with it's long dimension parallel to the sub-purlins, or perpendicular to the purlins. The sub-purlins are generally spaced 24" apart. The purlins are typically spaced 8 feet apart to accommodate the length of the plywood sheathing. The glulam beams are typically spaced 20 to 24 feet apart. Sections of the panelized roof are typically fabricated on the ground and raised into place with a crane or forklift.

In buildings with timber framed roof diaphragms, the major roof framing elements, such as beams, girders, and trusses, are used as diaphragm continuity elements to form a plurality of spaced continuity lines that extend across the length and width of a building, i.e., a diaphragm continuity system. The purpose of a diaphragm continuity system is to provide a discrete structural system that provides for the transfer of seismic, wind, or other forces from the walls of a building into the roof diaphragm, and eventually to the structural elements intended to resist such forces. Forces from the walls are typically transferred to the diaphragm continuity elements through a sub-diaphragm. A sub-diaphragm is generally taken to be a localized area of the roof diaphragm that spans between diaphragm continuity elements and extends into the diaphragm a certain distance. This distance is dependent on the shear capacity of the sub-diaphragm and the forces that are to be transferred through the sub-diaphragm.

In areas subject to high seismicity, the connection between the walls of most older concrete buildings and their timber roof framing system is inadequate per the currently established seismic design standards for such buildings. Generally, this connection consists of only the nailing between the roof sheathing and the timber ledger that is bolted to the wall. This type of connection relies on a mechanism that subjects the ledgers to "cross grain bending", a mechanism that is highly vulnerable to failure. The deficiencies associated with this type of connection were responsible for numerous failures and collapses of concrete buildings during the 1971 San Fernando Earthquake. As a result, this type of connection has been specifically disallowed since the 1973 Edition of the Uniform Building Code. It is generally recommended that concrete buildings with such deficiencies be retrofitted with new connections per the currently established seismic design standards and/or recommendations for such buildings.

In some buildings constructed prior to the 1973 Edition of the uniform Building Code, and in most constructed afterwards, the walls of concrete, concrete tilt-up, and concrete block buildings are attached to the roof diaphragm, or sub-diaphragms, with discrete walls ties. Such wall ties generally consists of timber blocks or struts that are interconnected with metal straps, rods, holddown type connection devices, such as those disclosed in U.S. Pat. No. 5,249,404, or a combination thereof, and are only designed to resist tension forces, or may consist of the recently developed wall tie system disclosed in U.S. Pat. No. 5,809,719. These "conventional" wall tie systems generally consist of many individual components that can take a significant amount of time to install, especially when the roof diaphragm is sloped (as is generally required for drainage, sometimes significantly) and the walls are not orthogonal to the diaphragm continuity elements. In many buildings, particularly older buildings with unblocked joisted non-panelized roof diaphragms, the sub-diaphragm shear capacity may be very limited, and require that those wall tie systems that rely on sub-diaphragms be extended from the wall into the roof diaphragm a significant distance in order to increase the depth of the sub-diaphragm, and hence reduce the sub-diaphragm shear stresses to within acceptable limits. Such conventional wall tie systems can be very costly.

SUMMARY OF THE INVENTION

It is therefore an object of the present invention to provide a simplified and cost effective seismic connection mechanism for transferring both tension and compression forces from the walls of buildings to their diaphragm continuity elements.

Another object of the present invention is to provide a seismic connection of the type described for connecting the walls of concrete buildings to diaphragm continuity elements consisting of the major roof framing elements such as beams, girders and trusses.

Yet another object of the present invention is to provide a seismic connection of the type described which is capable of transferring both tension and compression forces from building walls into the overall roof diaphragm through the beams, girders and/or trusses thereof.

Still another object of the present invention is to provide a seismic connection of the type described that eliminates dependence on the sub-diaphragm as a means of preserving wall to diaphragm integrity.

Briefly, a preferred embodiment of the present invention includes either a single or a plurality of strut pairs, each forming an assembly for transferring force between a wall and a roof diaphragm continuity element. Each assembly is comprised of two elongated strut elements, or load transfer members, each including a member at one end that allows longitudinal adjustment and rotation thereof, a first end connector assembly for facilitating connection of one end of the strut element to a wall, and a second end connector assembly for facilitating attachment of the other end of the strut element to a diaphragm continuity element connection assembly, the latter assembly being adapted to combine with a corresponding connection assembly and sandwich the continuity element therebetween. Each strut element is adapted to angularly intersect both the engaged wall and the diaphragm continuity element at angles which are determined by the particular buildings design.

An important advantage of the present invention is that it provides a reliable load transfer mechanism for use in structurally attaching the walls of new or existing tilt-up, concrete or concrete block wall buildings to their major roof framing elements.

Another advantage of the present invention is that it provides a simplified connection mechanism that can be used to connect walls and roof framing elements intersecting each other at any angle, either horizontally, vertically or both.

A further advantage is that it includes relatively lightweight components that can be manually installed without the use of heavy lifts, jacks, etc.

These and other objects and advantages of the present invention will no doubt become apparent to those skilled in the art after having reviewed the following detailed description of the preferred embodiments illustrated in the several figures of the drawing.

IN THE DRAWING

DETAILED DESCRIPTION OF THE PREFERRED EMBODIMENTS

Figure 1:
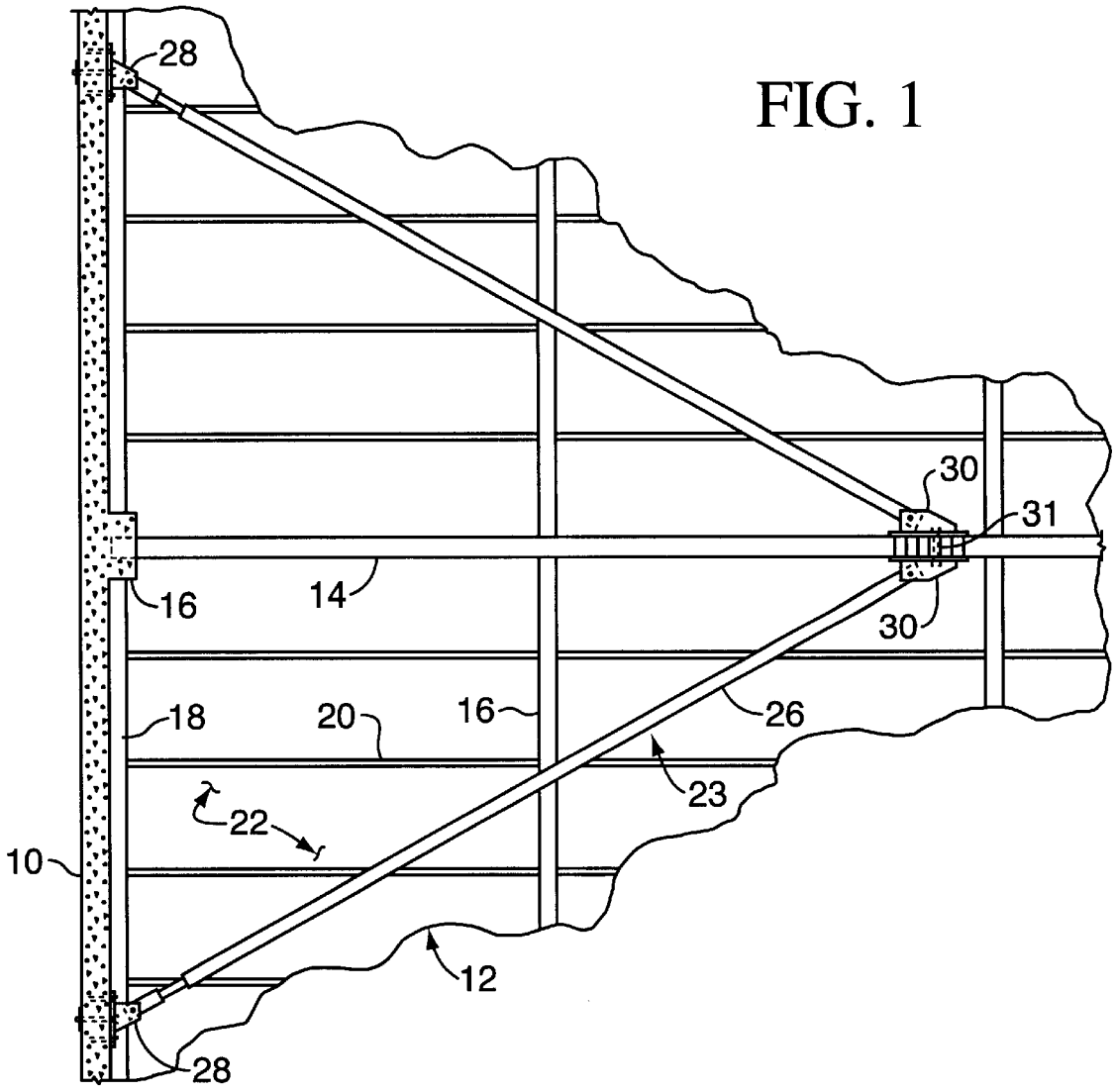
FIG. 1 is a bottom plan view illustrating a flare strut assembly in accordance with the present invention.

Referring now to FIG. 1 of the drawing wherein a bottom plan view of a segment of a concrete wall 10 and building roof 12 are depicted, it will be appreciated that the panelized roof structure consists of main supporting beams or trusses 14 that form diaphragm continuity members that span between the walls and rest upon support columns or posts 16 either formed integral with or attached to the adjacent wall. In this case, the illustrated continuity member 14 is a large glulam beam (See FIG. 2). Spanning between adjacent beams are purlins 16, and spanning between the purlins 16 or a purlin and a ledger beam 18, are sub-purlins 20. And finally, attached to and spanning between subpurlins are rectangular sheets 22 of roof sheathing.

Mounted to the wall and roof structure, typically at each junction of continuity beam and wall, are flare strut assemblies 23, including first and second struts 24 and 26, and their associated end fastening subassemblies 28 and 30.

The Flare Strut System of the present invention provides an alternate to conventional wall tie systems that might consist of strap and block systems, rod and block systems, strap and strut systems, rod and strut systems, or the recently developed DS Dragline System (developed for "tilt-up" buildings with panelized roof framing systems, (See U.S. Pat. No. 5,809,719). These conventional wall tie systems generally consist of many individual components that can take a significant amount of time to install, especially when the roof diaphragm is sloped (as is required for drainage, sometimes significantly) and the walls are not orthogonal to the diaphragm continuity elements, and rely on a subdiaphragm (a localized area of the roof diaphragm that spans between diaphragm continuity elements) to transfer forces from the walls to the diaphragm continuity elements. In many tilt-up" type buildings, particularly older buildings with unblocked joisted (non-panelized) roof diaphragms, the subdiaphragm shear capacity may be very limited, and require that those wall tie systems that rely on subdiaphragms be extended from the wall into the roof diaphragm a significant distance in order to increase the depth of the subdiaphragm, and hence reduce the subdiaphragm shear stresses to within acceptable limits. Such wall tie systems can be very costly. Since the present invention provides for a direct connection between the walls of a "tilt-up" or other concrete walled building and its diaphragm continuity elements, the subdiaphragm is bypassed, and any capacity related problems associated with that subdiaphragm are eliminated. Furthermore, since the strut assemblies of the present invention install simply and quickly, the installation costs associated therewith can be significantly less than those associated with conventional systems.

As indicated above, the preferred embodiment of the FS Flare Strut System is comprised of a combination of struts 24, 26 designated "Flare Strut (FS)", a first end connector assembly 28 designated "End Connection Type 1 (EC-1)" which provides for the attachment of the Flare Strut to the wall, and a second end connector assembly 30 designated "End Connection Type 2 (EC-2)", which provides for the attachment of the flare strut to a roof framing element (beam, girder, or truss). A Shear Transfer Plate (STP) for both EC-1 and/or EC-2, may be included as required.

Figure 3:
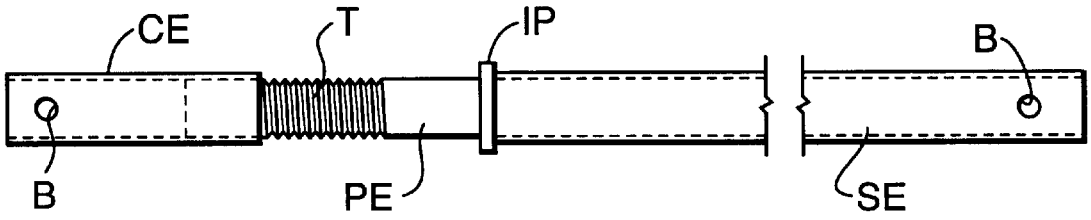
FIGS. 3 and 4 illustrate alternative embodiments of a strut member.

As depicted in FIG. 3, the flare strut consists of a Strut Element (SE), an Interface Plate (IP), a Pipe Element (PE), and a Coupler Element (CE). The SE generally may consist of either a structural steel pipe (round) or tubular (square or rectangular) section. Generally, square rectangular tubing will most often used for the SE, as it is readily available, and typically lighter than an equivalent pipe section. The SE is attached to the IP by welding or brazing. The IP consists of either a square (typically), round, or multi sided steel plate, and is then welded or brazed to the PE, serving to attach the SE to the PE. The PE consists of a steel pipe section (that may also be solid round stock or threaded rod) with external (or internal) right hand (or left hand) threads, and is threaded into (or onto) the CE. The CE consists of a steel pipe section (that may also be solid round stock or threaded rod if provided with external threads) with internal (or external) right hand (or left hand) threads. The threaded connection between the PE and the CE allows the FS to freely rotate about the longitudinal axis of the FS, thus providing the FS System with one degree of articulation, as well as allowing the overall length of the FS to be adjusted for field fit-up.

Figure 2:
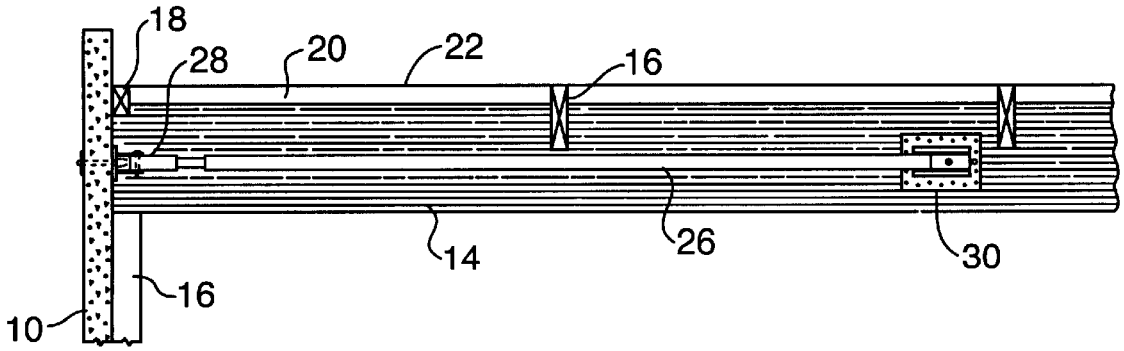
FIG. 2 is an elevational view showing one strut of the assembly illustrated in FIG. 1.

Both the SE and CE of the flare strut may be attached to either EC-1 or EC-2 type connectors since both EC-1 and EC-2 are attached to the strut ends with a single pin bolt passed through the bores. This provides the FS System with a second degree of articulation. As shown in FIGS. 1 and 2, both the EC-1 (wall) connector 28 and the EC-2 connector 30 (diaphragm continuity element) are attached to their designated building element with a single connection bolt. This provides the FS System with a third degree of articulation.

Figure 4:
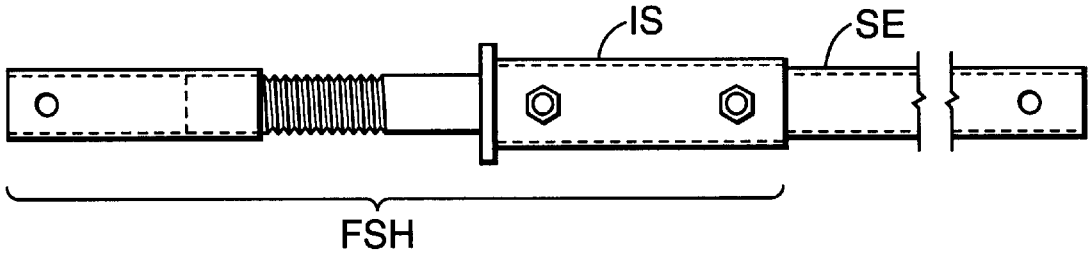

As an alternate, the FS may be modified as shown in FIG. 4 with the addition of an Interface Sleeve (IS) to form a Flare Strut Head (FSH). This head configuration allows for either a bolted connection or an aligned and welded connection between the SE and the Flare Strut Head (FSH) and thus permits an installer to combine the FSH with a field cut and drilled SE to readily accommodate strut length variations or changes in the field.

Figure 5:
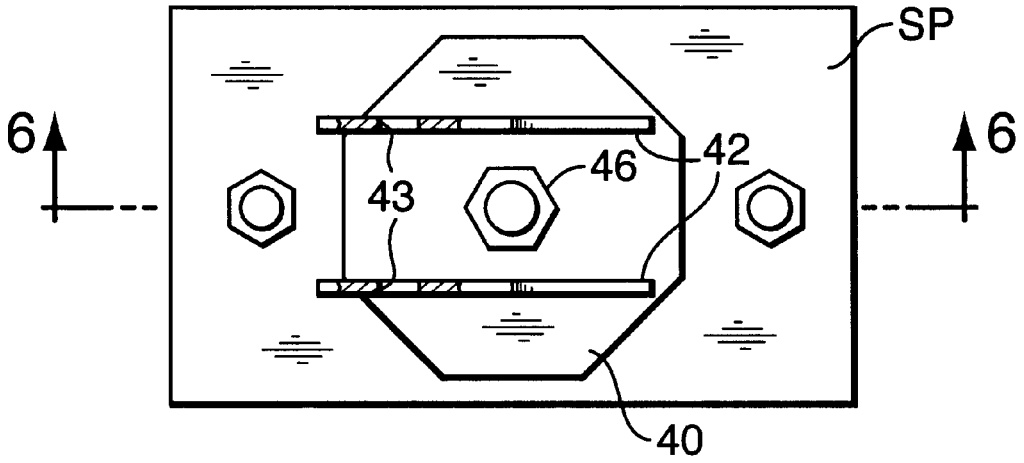
FIG. 5 is a plan view showing a wall connection end connector assembly.
Figure 6:
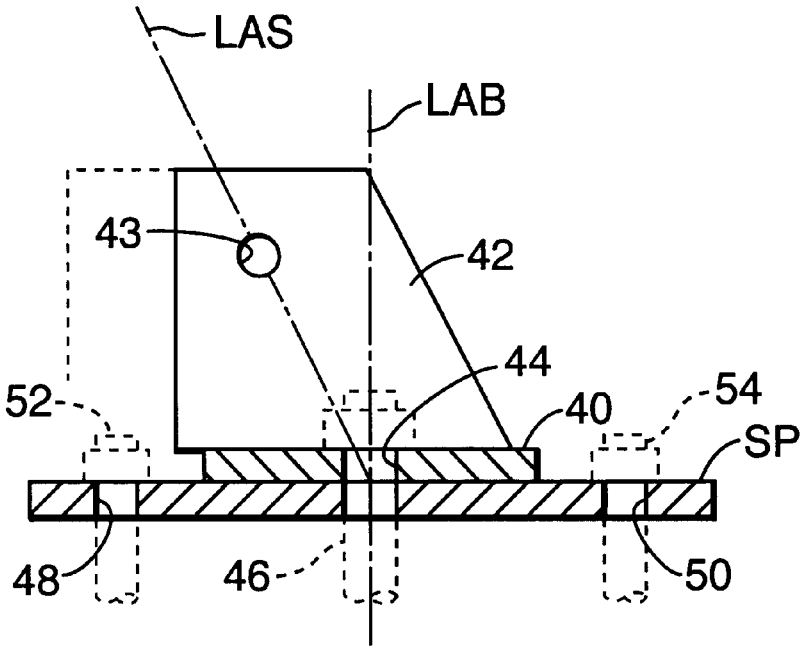
FIG. 6 is an elevational cross-section taken along the lines 6—6 of FIG. 5.

The EC-1 connector is illustrated in detail in FIGS. 5 and 6 and consists of a base plate 40 and two connection plates 42 welded thereto. The plates 42 have matching holes 43 for receiving a connection bolt or pin (not shown). The base plate may be square, rectangular, round, or multi sided, and is provided with at least one hole 44 for receiving a connection bolt or pin (not shown). The connection plates may be square, rectangular, or otherwise shaped to provide the installer and inspector with a visual reference as to the allowable limits the strut to be attached thereto may be skewed relative to the EC-1 connector. Both the base plate and the connection plate may be modified as required to minimize the eccentricity between the line of action LAS along the strut and the line of action LAB along the connection bolt 46, and/or minimize the bearing pressure that the base plate might exert upon the building element to which it is to be attached.

If the shear capacity of the connection bolt 46 attaching the EC-1 connection to the building element is inadequate, then additional shear capacity can be derived with the installation of a Shear Plate (SP). The shear plate may consist of a square, rectangular, round, or multi-sided steel plate that is provided with holes 48 and 50 for concrete (or masonry) anchors 52 and 54, and perhaps additional holes (not shown) for nails, screws or lag bolts.

Figure 7:
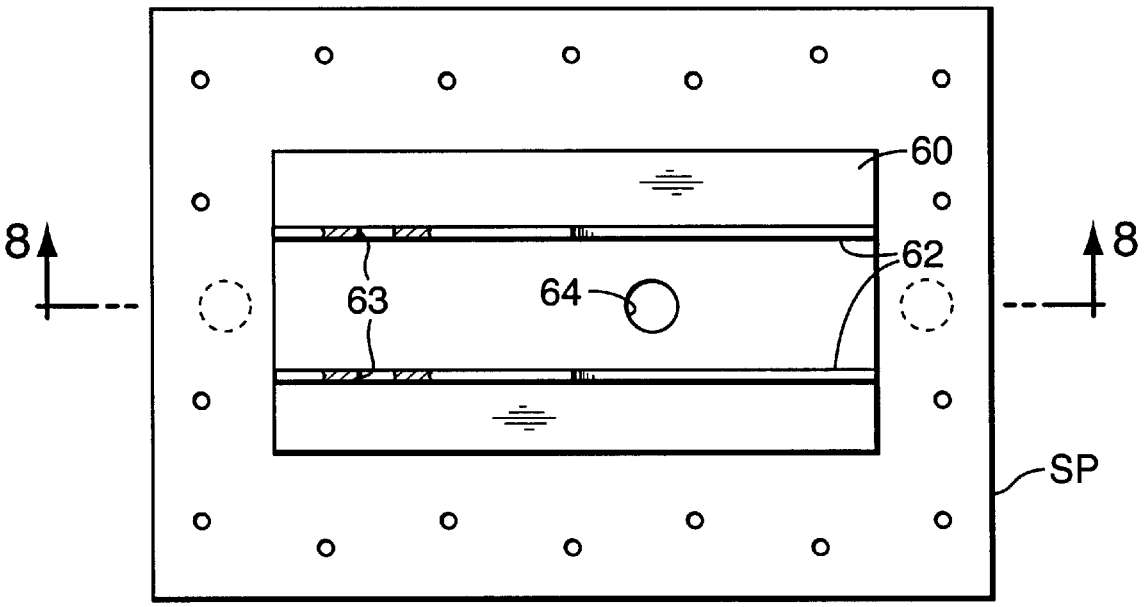
FIG. 7 is a plan view of a continuity member connection end connector assembly.
Figure 8:
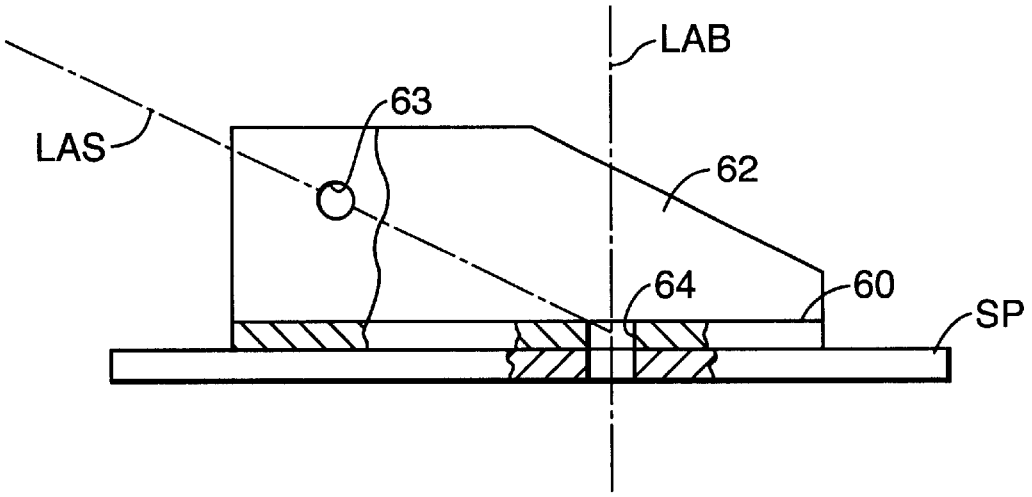
FIG. 8 is an elevational view partially sectioned along the lines 8—8 of FIG. 7.

The EC-2 connector is illustrated in detail in FIGS. 7 and 8 and consists of a base plate 60 and two connection plates 62 welded thereto. The plates 62 have matching holes 63 for receiving a connection bolt or pin. The base plate may be square, rectangular, round, or multi-sided, and is provided with a least one hole 64 for receiving a connection bolt or pin (not shown). The connection plates may be square, rectangular, or otherwise shaped to provide the installer and inspector with a visual reference as to the allowable limits the strut to be attached thereto may be skewed relative to the EC-2 connector. Both the base plate and the connection plate may be modified as required to minimize the eccentricity between the line of action LAS along the strut and the line of action LAB along the connection bolt and/or minimize the bearing pressure that the base plate might exert upon the building element to which it is to be attached.

If the shear capacity of the connection bolt attaching the connection EC-2 connection to the building element is inadequate, then additional shear capacity can be derived with the installation of a Shear Plate (SP). The shear plate may consist of a square, rectangular, round or multi-sided steel plate that is provided with holes for nails, screws, lag bolts or bolts.

Momentarily returning to FIG. 1, it will be noted that the connector assemblies 30 on each side of beam 14 are connected together by a common bolt 31 that is extended through the holes 64 (FIGS. 7 and 8) as well as through a hole drilled through beam 14. If shear plates SP are, used, they may be either independently by nailing, screwing, etc., or may be joined by bolts extending through bolt holes (not shown) formed in the beam and plates SP. Ideally, the assemblies 30 will be aligned.

But, in some cases, they can be staggered so long as provisions are made to resolve the unbalanced forces. The angle at which each strut intersects beam 14 is a matter of engineering design.

Figure 9:
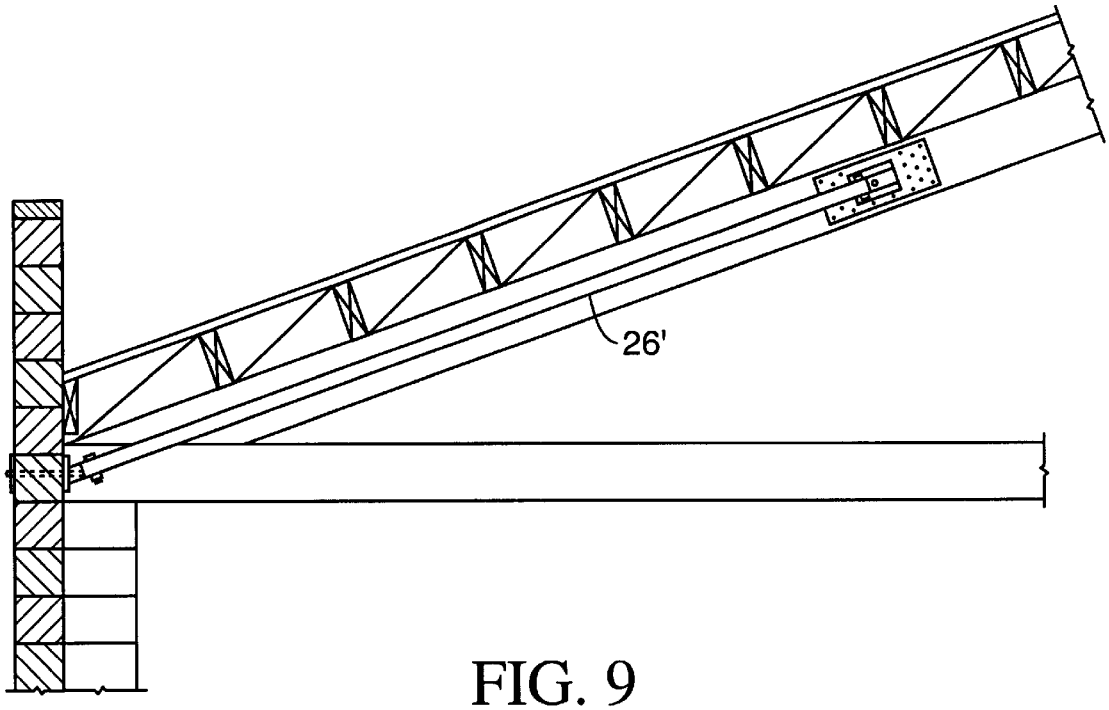
FIG. 9 is an elevational view illustrating a strut member engaging a block wall at an oblique angle.

In FIG. 9 an installation of the present invention to a concrete block building having a steeply sloped roof is depicted in partial cross-section to illustrate that the subject strut assembly can accommodate an angular connection angled at acute angles in more than one plane. This is permitted by rotation of the strut in one place, about its connecting pin and rotation of the strut in a second plane by rotating the connector about its attachment bolt.

Figure 10:
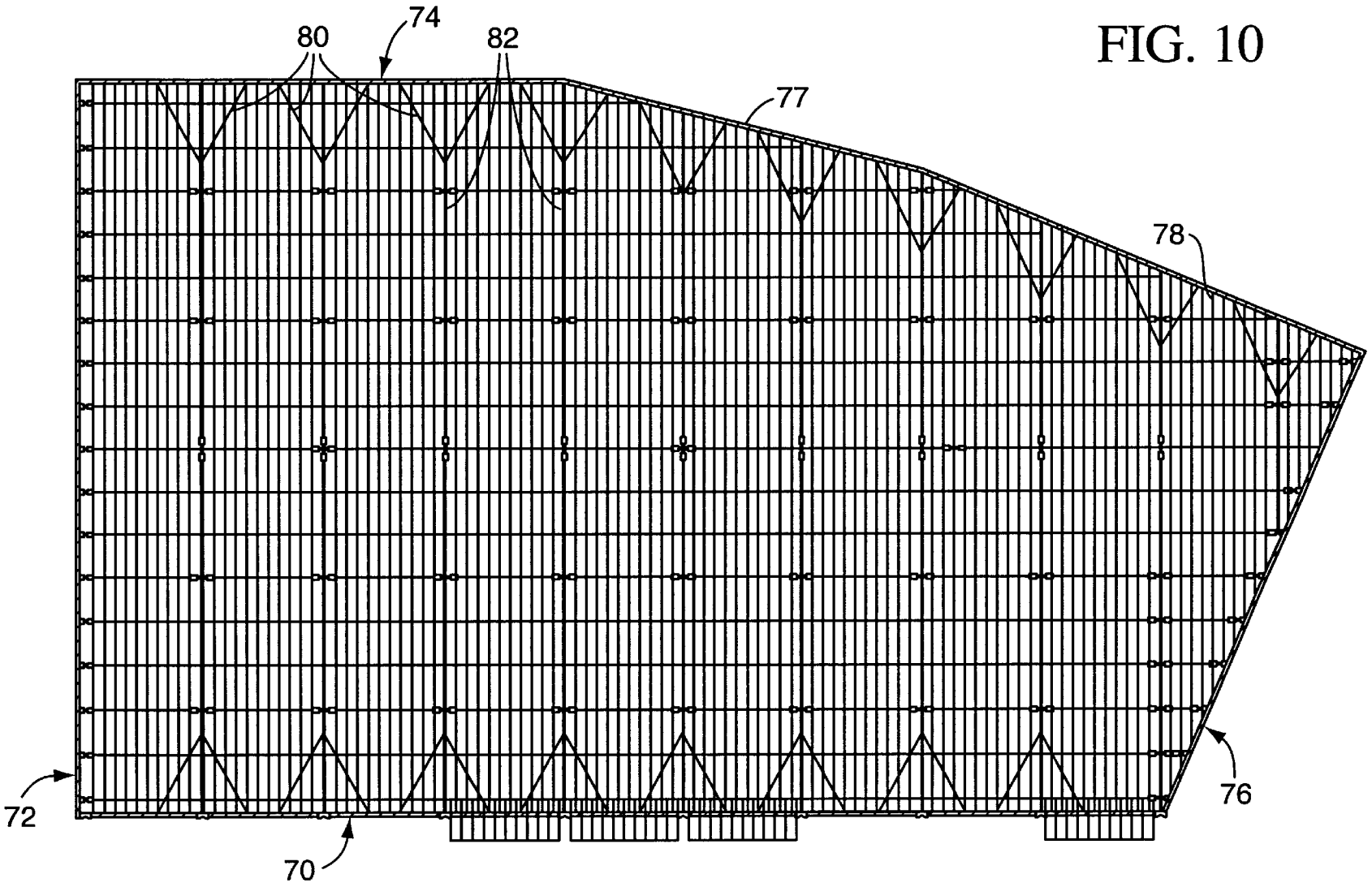
FIG. 10 is a partially broken plan view schematically showing use of the flare strut stem of the present invention.

FIG. 10 is a plan view depicting an exemplary installation of the FS System in a building having two orthogonally disposed walls 70 and 72 and two walls 74 and 76 that are at least in part non-orthogonally oriented relative to the other walls. As shown, a strut assembly 80 is installed at each intersection of a beam or other roof diaphragm continuity element 82. Note that the non-orthogonal wall segments 77 and 78 are accommodated by simply shortening the length of one of the struts in each strut assembly.

The walls 72 and 76, and wall segments 77 and 78 are interconnected in this drawing using the apparatus and techniques disclosed in U.S. Pat. No. 5,813,181.

Although the present invention has been described in terms of specific embodiments it is anticipated that alterations and modifications thereof will no doubt become apparent to those skilled in the art. It is therefore intended that the following claims be interpreted as covering all such alterations and modifications as fall within the true spirit and scope of the invention.

What I claim is:

1. A system for improving the transfer of tension and compression forces between the walls and roof or floor diaphragm of a concrete or masonry building, comprising:

a plurality of load transferring strut assemblies for retrofit to building walls and intersecting continuity elements forming structural components of generally planar roof or floor diaphragms affixed to the walls so that tension and compression forces generated by seismic, wind and other forces applied thereto are properly transferred between the walls and diaphragms, each said strut assembly including a pair of adjustable, elongated load transfer members adapted to lie in a plane generally parallel to the plane of an associated diaphragm and to extend from a building wall and to angularly intersect a particular continuity element of said associated diaphragm at an angle of substantially less than 45 degrees, first end connection sub-assemblies adapted to secure one end of each of said pair of load transfer members to the wall at one of a pair of spaced apart locations on opposite sides of the intersection of the particular continuity element, second end connection sub-assemblies adapted to secure the opposite ends of said load transfer members to the diaphragm continuity element, and fasteners for pivotally securing said first and second sub-assemblies to said wall and to said diaphragm continuity element such that each said strut assembly lies in the plane of the associated diaphragm and becomes a permanent structural addition to the building and provides a permanent fixture for transferring tension and compression forces between the wall and roof diaphragm, wherein each said sub-assembly includes a base plate having a fastener receiving aperture formed therein, and a pair of outwardly extending connection plates affixed to said base plate, each said connection plate having a pin receiving aperture formed therein, wherein each end of each said load transfer member is pivotally attached to an associated end connection subassembly by a pin extending though said pin receiving apertures and an aperture in the end of said load transfer member, wherein said fasteners include bolts, wherein each said first end connection sub-assembly is adapted to be secured to said one wall by at least one of said bolts extending through a bolt receiving aperture formed therein, and wherein first shear plates are disposed between each said first end connection sub-assembly and said one wall, each said first shear plate having an aperture through which said one of said bolts is adapted to extend.

2. A system for improving the transfer of tension and compression forces as recited in claim 1 wherein said second end sub-assemblies are adapted to be positioned on opposite sides of said particular continuity element and are adapted to be secured together by at least one bolt extending through the fastener receiving aperture thereof.

3. A system for improving the transfer of tension and compression forces as recited in claim 1 wherein said load transfer member includes first and second components threadably coupled together to accommodate rotation and length adjustment.

4. A system for improving the transfer of tension and compression forces as recited in claim 3 wherein at least one of said first and second components includes a hollow tubular member of round or polygonal cross-section.

5. A system for improving the transfer of tension and compression forces as recited in claim 4 wherein said hollow tubular member is connected to a threaded solid member by an interface plate.

6. A system for improving the transfer of tension and compression forces as recited in claim 4 wherein said hollow tubular member has an end matingly engaged and mechanically fastened to a hollow sleeve affixed to a threaded member.

7. A system for improving the transfer of tension and compression forces as recited in claim 1 wherein said second shear plates include further apertures through which nails, screws or lag bolts may be extended.

8. A system for improving the transfer of tension and compression forces between the walls and roof or floor diaphragm of a concrete or masonry building, comprising:

a plurality of load transferring strut assemblies for retrofit to building walls and intersecting continuity elements forming structural components of generally planar roof or floor diaphragms affixed to the walls so that tension and compression forces generated by seismic, wind and other forces applied thereto are properly transferred between the walls and diaphragms, each said strut assembly including a pair of adjustable, elongated load transfer members adapted to lie in a plane generally parallel to the plane of an associated diaphragm and to extend from a building wall and to angularly intersect a particular continuity element of said associated diaphragm at an angle of substantially less than 45 degrees, first end connection sub-assemblies adapted to secure one end of each of said pair of load transfer members to the wall at one of a pair of spaced apart locations on opposite sides of the intersection of the particular continuity element, second end connection sub-assemblies adapted to secure the opposite ends of said load transfer members to the diaphragm continuity element, wherein each said sub-assembly includes a base plate having a fastener receiving aperture formed therein, and a pair of outwardly extending connection plates affixed to said base plate, each said connection plate having a pin receiving aperture formed therein, and fasteners for pivotally securing said first and second sub-assemblies to said wall and to said diaphragm continuity element such that each said strut assembly lies in the plane of the associated diaphragm and becomes a permanent structural addition to the building and provides a permanent fixture for transferring tension and compression forces between the wall and roof diaphragm, said fasteners including bolts, and shear plates for disposition between each said second end connection sub-assembly and said particular continuity element, said shear plates having an aperture through which one of said bolts is adapted to extend.

9. A system for improving the transfer of tension and compression forces as recited in claim 8 wherein said load transfer member includes first and second components threadably coupled together to accommodate rotation and length adjustment.

10. A system for improving the transfer of tension and compression forces as recited in claim 9 wherein at least one of said first and second components includes a hollow tubular member of round or polygonal cross-section.

11. A system for improving the transfer of tension and compression forces as recited in claim 10 wherein said hollow tubular member is connected to a threaded solid member by an interface plate.

12. A system for improving the transfer of tension and compression forces as recited in claim 10 wherein said hollow tubular member has an end matingly engaged and mechanically fastened to a hollow sleeve affixed to a threaded member.

13. A building system having improved structural integrity, comprising:

means forming building walls;

at least one diaphragm forming a generally planar roof or floor structure secured to said walls and including continuity elements forming structural components thereof intersecting said walls for transferring tension and compression forces between the walls and said diaphragm;

a plurality of load transferring strut assemblies connected between said walls and said continuity elements, each said strut assembly including a pair of elongated, longitudinally adjustable load transfer members adapted to lie in a plane generally parallel to the plane of an associated diaphragm and extending from one of said walls, and angularly intersecting a particular diaphragm continuity element at an angle of substantially less than 45 degrees, first end connection sub-assemblies respectively pivotally securing one end of each of said pair of load transfer members to said one of said walls at spaced apart locations on opposite sides of said particular continuity element, and second end connection sub-assemblies respectively pivotally securing another end of each of said pair of load transfer members to said particular continuity element intersecting said one of said walls intermediate said spaced apart locations, said first and second sub-assemblies having fastener receiving apertures formed therein being respectively secured to said one of said walls and to said particular continuity element by fasteners extending through said wall and continuity element such that each said strut assembly lies in the plane of the associated diaphragm and forms a permanent structural addition to the building and provides a permanent fixture for enhancing the transfer of tension and compression forces between the wall and diaphragm, and shear plates for disposition between each said second end connection sub-assembly and said particular continuity element, said second shear plates having a fastener receiving aperture formed therein, wherein said second end connection sub-assemblies and associated shear plates are positioned on opposite sides of said particular continuity element and are secured together by at least one said bolt forming a fastener means extending through the fastener receiving apertures thereof.

14. A building system as recited in claim 13 wherein each said end connection sub-assembly includes a base plate having a fastener receiving aperture formed therein, and a pair of outwardly extending connection plates affixed to said base plate, each said connection plate having a pin receiving aperture formed therein.

15. A building system as recited in claim 14 wherein each end of each said load transfer members is pivotally attached to an associated end connection subassembly by a pin extending though a pair of pin receiving apertures and an aperture formed in the end of the load transfer member.

16. A building system as recited in claim 13 wherein each said first end connection sub-assembly is secured to said one wall by at least one bolt extending through the bolt receiving aperture thereof and said wall.

17. A building system as recited in claim 13 wherein said second shear plates include further apertures through which nails, screws or lag bolts may be extended.

18. A building system as recited in claim 13 wherein each said load transfer member includes first and second components threadably coupled together to accommodate rotation and length adjustment.

19. A building system as recited in claim 18 wherein at least one of said first and second components includes a hollow tubular member of round or polygonal cross-section.

20. A building system as recited in claim 19 wherein said hollow tubular member is connected to a threaded solid member by an interface plate.

21. A building system as recited in claim 19 wherein said hollow tubular member has an end matingly engaged and mechanically fastened to a hollow sleeve affixed to a threaded member.

22. A building system as recited in claim 13 and further including first shear plates for disposition between each said first end connection sub-assembly and said one wall, each said shear plate having an aperture through which said bolt extends.

23. A building system having improved structural integrity, comprising:

means forming building walls;

at least one diaphragm forming a roof or floor structure secured to said walls and including continuity elements intersecting said walls for transferring tension and compression forces between the walls and said diaphragm;

a plurality of load transferring strut assemblies connected between said walls and said continuity elements, each said strut assembly including a pair of elongated, longitudinally adjustable load transfer members, first end connection sub-assemblies securing one end of each of said pair of load transfer members to one of said walls at spaced apart locations, shear plates for disposition between each said first end connection sub-assembly and said one wall, each aid shear plate having an aperture formed therein, second end connection sub-assemblies securing another end of each of said pair of load transfer members to a particular continuity element intersecting said one of said walls intermediate said spaced apart locations, said first and second sub-assemblies being respectively secured to said one of said walls and to said particular continuity element by fasteners, including bolts, extending through said walls and continuity elements such that each said strut assembly forms a permanent structural addition to the building and provides a permanent fixture for enhancing the transfer of tension and compression forces between the wall and diaphragm, and wherein each said first end connection sub-assembly and its associated shear plate are secured to said one wall by at least one said bolt extending through the bolt receiving apertures thereof and said wall.

24. A building system as recited in claim 23 wherein each said load transfer member includes first and second components threadably coupled together to accommodate rotation and length adjustment.

25. A building system as recited in claim 24 wherein at least one of said first and second components includes a hollow tubular member of round or polygonal cross-section.

26. A building system as recited in claim 25 wherein said hollow tubular member is connected to a threaded solid member by an interface plate.

27. A building system as recited in claim 25 wherein said hollow tubular member has an end matingly engaged and mechanically fastened to a hollow sleeve affixed to a threaded member.

* * * * *